United States Patent [19]

Shipos et al.

[11] Patent Number: 4,525,088

[45] Date of Patent: Jun. 25, 1985

[54] COMPACT ROTARY KNIFE MECHANISM

[75] Inventors: Louis E. Shipos, Ithaca; Steven I. Tinker, Brooktondale, both of N.Y.

[73] Assignee: NCR Corporation, Dayton, Ohio

[21] Appl. No.: 525,203

[22] Filed: Aug. 22, 1983

[51] Int. Cl.[3] ..... B41J 11/70

[52] U.S. Cl. ..... 400/621; 101/93.07; 83/508

[58] Field of Search ..... 400/621, 621.2; 101/93.07; 83/477.2, 487, 508

[56] References Cited

U.S. PATENT DOCUMENTS 3,951,252 4/1976 Selke et al. ..... 400/621

4,003,281 1/1977 Kumpf et al. ..... 83/477.2

4,152,962 5/1979 Hendrischk ..... 83/508

*Primary Examiner*—Paul T. Sewell

*Attorney, Agent, or Firm*—Wilbert Hawk, Jr.; George J. Muckenthaler

[57] ABSTRACT

A rotary knife mechanism for severing record media is carried along with the printing mechanism to provide a compact cutting device for full or partial cutting of the media in either direction of travel of the printing mechanism. The position of the rotary knife in relation to a cooperating member is controlled by a solenoid programmed in timed manner to move the knife from a cam-supported position to an operating position as the printing mechanism is caused to be traversed across the printer.

30 Claims, 7 Drawing Figures

COMPACT ROTARY KNIFE MECHANISM

BACKGROUND OF THE INVENTION

In the field of printing, the use of a printed receipt as a proof of purchase of merchandise for the benefit of the customer is a common business practice. The receipt is a printed record showing the purchase of one or more items in a merchandising transaction that may also include the printing of a journal tape to provide a permanent record of such transaction and which journal tape is retained in the receipt-issuing printer. The receipt for such transaction is normally derived from a roll of paper tape or like record media wherein, after printing of the transaction is completed, a portion or strip of the paper on the roll is separated therefrom as by a tearing or cutting action. A common method in the tearing operation utilizes a tear-off member installed on the printer and having a serrated or like edge along which the paper tape is manually disposed and the receipt is caused to be separated at a line across the tape when a portion thereof is removed in the tearing action. In certain other cases, the paper tape may be fashioned to include spaced rows of perforations or lines of weakening along which a receipt or like portion of a tape is removed from the roll.

The use of cutting devices or like severing mechanisms also has evolved over the years in printing operations to provide the printed receipts in a manner wherein the severing or cutting operation is performed by the device or mechanism after the printing of certain information is completed on the receipt portion of the paper roll and while the receipt portion is still a part thereof. The two common methods of severing or cutting the paper tape are accomplished by means of a slicing action or by a shearing action. The slicing concept includes the use of a slot or like recess along an anvil or platen member and across which the paper tape is trained in a taut manner and a cutting device with a knife edge positioned at the slot is caused to be operated therealong for cutting the tape. The shear concept includes the use of an anvil or platen member having a straight edge along one side thereof and against which the paper or like record media is trained and a cutting device with a knife edge is caused to be moved against and along the edge for cutting the paper.

Representative documentation in the field of cutting or severing paper or like record media in printing operations includes U.S. Pat. No. 3,115,827, issued to A. Muhlbach et al. on Dec. 31, 1963, which discloses apparatus for severing records wherein a cutting plate is mounted in a block by means of a pin and is held in an upper position by a tension spring. The upper position is determined by the combination of cam means and a two-arm lever in an arrangement wherein rotation of the cam means moves the cutting plate downwardly so that a cutting edge of the plate cooperates with a cutting anvil to sever a merchandise tag.

U.S. Pat. No. 3,951,252, issued to R. Selke et al. on Apr. 20, 1976, discloses an electromechanical writing device that includes coupling means for coupling a rotary knife carrier to a print head carrier and rotary cutting mechanism that includes the rotary knife and carrier that are movable with the print head. The knife operates along and in contact with the edge of the platen. The paper is caused to be moved past the edge of the platen and the cutting mechanism utilizes rollers and a spring for sliding and urging action of the knife relative to the platen edge for shearing the paper.

U.S. Pat. No. 4,003,281, issued to S. S. Kumpf et al. on Jan. 18, 1977, discloses record material cutting mechanism wherein a motor causes a cam arm member to pivot or rotate about a shaft and allow a stud member to rock the knife arm, which has a knife or cutting wheel thereon, about a pin or stud while the cutting wheel moves in a rectilinear plane along a slot in a guide member. The cutting wheel is loaded or urged by a compression spring and extends through a slot in a top portion of the guide member into a recessed area. The cutting wheel is moved into engagement with a shear edge of the recessed area by the compression spring which is mounted between the wheel and a guide roller. The guide roller rides on a surface of a guide support which has a cam surface to guide the wheel in a horizontal direction to traverse the receipt strip in cutting movement.

U.S. Pat. No. 4,302,119, issued to F. Siegenthaler on Nov. 24, 1981, discloses a matrix printer with a cutting device wherein a knife blade is integral with a cam carrier of a planar sliding cam drive roller. Three cam sections on the carrier are engageable by the cam roller and the blade is caused to be moved toward and away from the cutting position by contact of the cam roller with the respective inclined and reversely inclined cam sections.

SUMMARY OF THE INVENTION

The present invention relates to a severing or cutting mechanism for use on a dot matrix printer. More particularly, the invention provides for severing or cutting portions in the form of strips from a paper tape or like record media wherein the strips bear printing matter thereon which is evidence of proof of purchase of one or more items in a merchandising transaction. The paper tape from a roll thereof is caused to be driven past a printing station along which a wire matrix print head is operated to print in both directions of travel and, after completing the printing operation of the transaction, the tape is severed to provide a receipt of the transaction for the customer.

A preferred embodiment of the invention discloses mechanism operating in a severing or cutting motion which utilizes the shear concept wherein a rotary knife is carried along with the print head as the head is moved in back-and-forth manner across the printer, and such knife is caused to be positioned at the edge of an anvil member during the cutting operation. An electromagnetic solenoid is actuated to move the rotary knife from a position atop a cam member to a lowered position wherein the blade of the knife is at the edge of the anvil member for cutting the paper. The rotary knife includes a drive roller attached or connected thereto for contacting and frictionally engaging the paper for holding thereof at a desired position during the cutting operation and for ensuring precise rotation of the knife by contact of the roller with the paper and against the anvil member. The solenoid control and the sequential operation thereof are programmed to provide for either full or partial cutting of the paper tape as desired after the printing operation is completed and upon transverse motion of the print head and the knife mechanism.

A modified arrangement for cutting the paper tape to provide a receipt of the transaction includes a rotary knife mechanism carried along with the print head and which utilizes a slicing concept wherein the paper is trained in a path across a slot adjacent the printing station. The rotary knife is moved into position by actuation of a solenoid and the rotary motion of the knife along the slot causes slicing of the paper. A drive roller is attached or connected with the rotary knife and is moved into position to contact the paper and against an anvil member to rotate the knife and to cut the paper.

In view of the above discussion, the principal object of the present invention is to provide a compact rotary knife mechanism on a printer for severing or cutting a paper tape.

Another object of the present invention is to provide a rotary knife mechanism that is supported from and carried on a print head carriage and travels in transverse manner therewith.

An additional object of the present invention is to provide a rotary knife mechanism carried by the print head and operable to partially or fully sever the paper tape in either direction of travel of the print head.

A further object of the present invention is to provide a rotary knife mechanism of minimum mass and weight to enable carrying thereof by the printing apparatus in manner and construction which does not affect printing characteristics of the apparatus during the printing operation.

Still another object of the present invention is to provide a rotary knife mechanism carried by the print head and which is reliable in operation, simple in construction and low in cost.

Still an additional object of the present invention is to provide cam means and actuating means as part of the knife mechanism for positioning the rotary knife for severing or cutting the paper tape.

Still a further object of the present invention is to provide a compact knife mechanism associated with and carried by the print head in an arrangement permitting minimum space of the printing station.

Additional advantages and features of the present invention will become apparent and fully understood from a reading of the following description taken together with the annexed drawing.

DESCRIPTION OF THE PREFERRED EMBODIMENT

Figure 1:
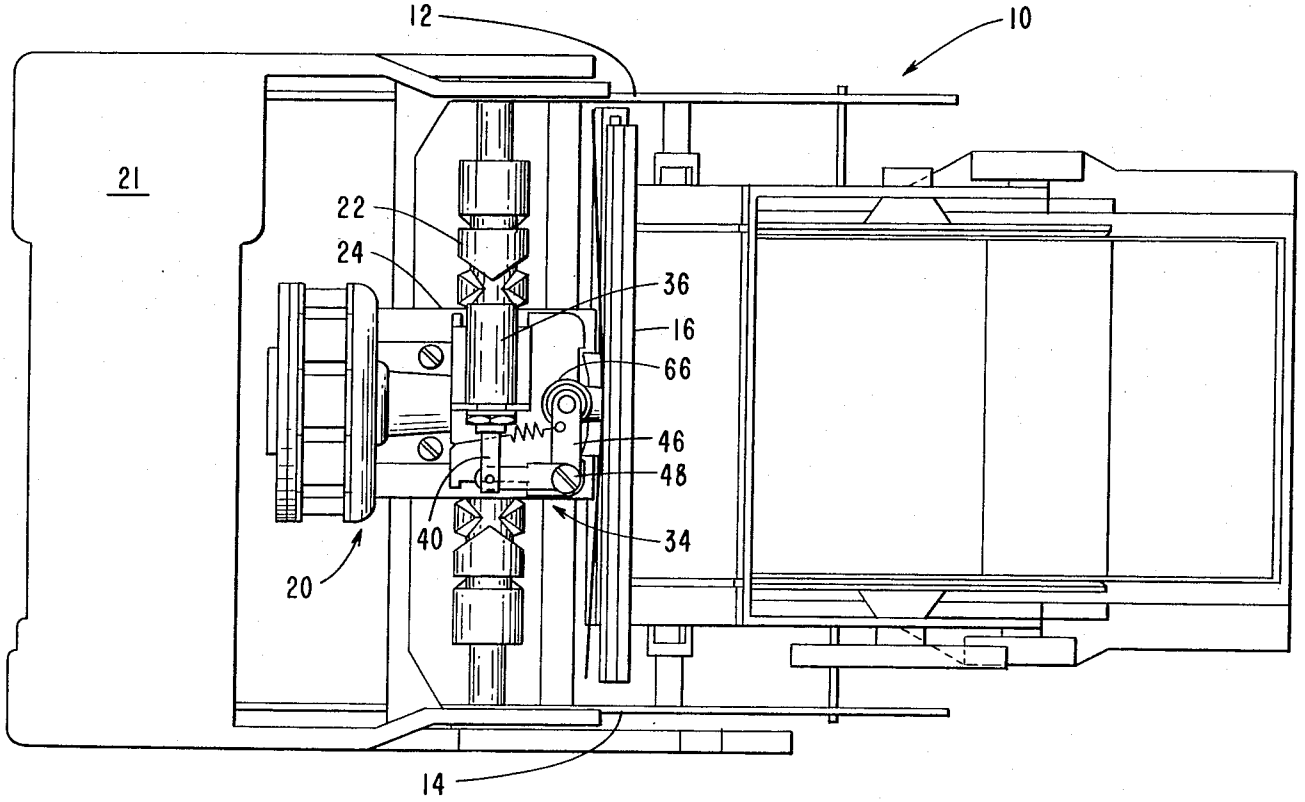
FIG. 1 is a top plan view in diagrammatic form showing a printer incorporating the subject matter of the present invention.

Referring now to the drawing, FIG. 1 is a top plan view of a dot matrix type printer 10 illustrated in outline form and incorporating a preferred embodiment of the present invention. The printer 10 includes side frame members 12 and 14 which provide support for the several parts associated with and making up the present invention. A coated metal platen 16 (see also FIG. 2) is supported from and between the side frames 12 and 14 and includes a surface portion 18 of the platen defining a print station or line along which a print head 20 is caused to be moved in transverse manner across the printer 10 and between the side frames. The rear portion of the printer 10 or that portion to the right side in FIG. 1 includes various mechanisms not a part of the present invention. A ribbon cassette 21 is supported on the front of the printer 10 and is positioned to provide a length of ribbon along the print station 18 and at the nose of the print head 20. A cam drive member 22 is operably driven in rotational manner by well-known and suitable means (not shown) and a plastic print head carriage 24 includes a follower 28 (FIG. 3) connected therewith and operable with the grooved cam member to cause the transverse movement of the carriage along with the print head 20. The cam drive member 22 for the print head 20 includes a cam slot 26 in the periphery of the drive member and the cam follower 28 rides in the slot in an arrangement wherein the construction of such drive mechanism is well-known in the printing art. Paper or like record material 30 (FIG. 3) is caused to be transported from a suitable core or spool (not shown), which spool may be positioned in the rear portion of the printer, upwardly past the printing station 18. A ribbon 32 (FIG. 2) is caused to be driven by suitable drive means (not shown), and operably associated with the cassette 21, in a generally horizontal direction between the print head 20 and the platen 16.

Figure 2:
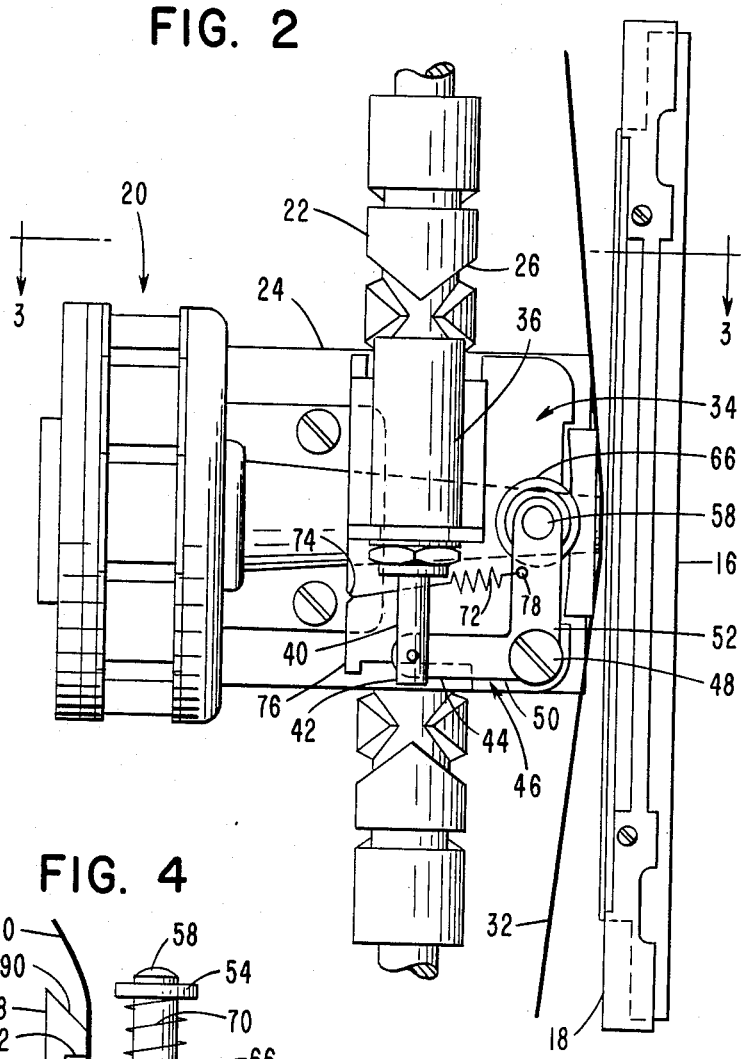
FIG. 2 is an enlarged top plan view of the compact rotary knife mechanism in a preferred arrangement thereof.
Figure 5:
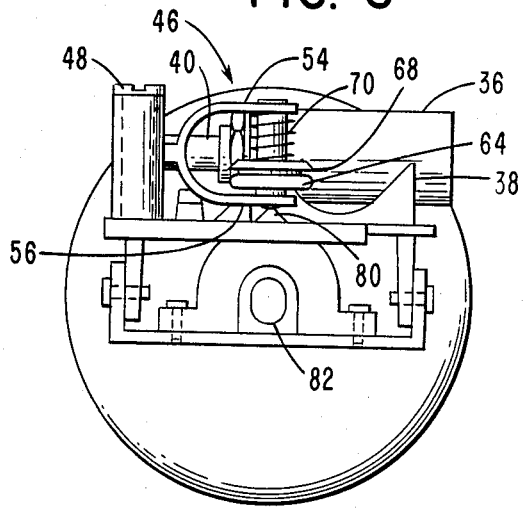
FIG. 5 is an elevational view taken on the line 5—5 of FIG. 3.

FIG. 2 illustrates an enlarged top plan view of the paper cutting mechanism 34 of the present invention, which mechanism is supported from and carried by the print head carriage 24 in the side-to-side direction along the print station or line 18. The paper cutting mechanism 34 includes an electromagnetic solenoid or like device 36 (see also FIGS. 3 and 5), which device is placed in a horizontal position and supported in a heat-dissipating cradle 38 operably secured to the print head carriage 24. The solenoid 36 has a plunger 40 extending toward the bottom of FIGS. 1 and 2 and toward the left in FIG. 5 and the end 42 (FIG. 2) of the plunger is pivotally connected to one end 44 of a plastic bell crank, generally designated 46, FIG. 5, which bell crank is pivoted at pin 48, and forms an arm portion 50 extending forwardly or to the right in FIG. 2 and toward the printing station 18. The bell crank 46 includes a cradle 52 extending toward the left side of the printer and upwardly in FIG. 2 and generally parallel with the solenoid plunger 40 and is curved in formed manner to provide an upper arm 54 and a lower arm 56, as seen in FIG. 5. A plastic pin or bell crank stud 58 is provided for the knife mechanism and is contained in journaled manner in appropriate, aligned apertures in the upper arm 54 and in the lower arm 56 of the cradle 52.

The knife mechanism 34 is made up as a portion of the assembly including the bell crank 46 in an arrangement wherein a washer or E-ring member 60 (FIG. 4) is placed on the stud or pin 58 to be retained in a suitable slot or groove therein at a precise position near the lower end 62 and just above the lower arm 56 of the bell crank. A drive member in the form of a neoprene roller 64, generally in the shape of an O-ring, is placed in a groove of a metal support member 65 which is on the pin 58 just above the E-ring 60. A rotary cutting member 66 of coated steel and having a single bevel edge 68 on the periphery thereof to form a rotary knife, and which may be an integral part with the O-ring support member 65, is positioned above the E-ring 60. A coil spring 70 is placed around the pin 58 between the rotary knife 66 and the upper arm 54 of the bell crank 46 to urge the parts in downward direction on the pin and against the E-ring 60.

A coil spring 72 (FIG. 2) is connected at one end thereof to a slot or groove 74 in a plate member 76 carrying the paper cutting mechanism 34, and is connected at the other end to an aperture 78 in the lower arm 56 of the cradle 52 of the bell crank 46 for holding or keeping the rotary blade 66 in a noncutting position away from the paper 30 and from the surface portion of the platen 16. In this position of the rotary knife 66, the lower end 62 of the pin or stud 58 is sitting atop a plastic conical-shaped cam member 80 (FIGS. 3 and 5) which is secured in an aperture of the member 76 directly above the nose 82 of the print head 20.

Figure 3:
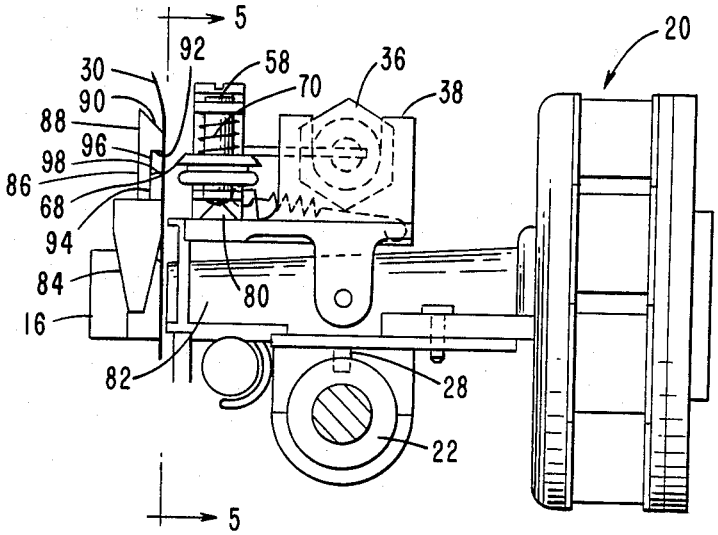
FIG. 3 is a side elevational view, taken on the line 3—3, of the mechanism shown in FIG. 2.

As seen in the side elevational view in FIGS. 3 and 4, the metal platen 16 is formed of a generally rectangular member and carries a plastic elongated member or knife anvil 84 connected thereto and extending across the printer 10 and which member 84 supports a plastic upstanding member 86 having an enlarged upper portion 88 with a slanting or sloping surface 90 directed toward the knife mechanism 34 and an undercut surface 92 spaced a short distance below the sloping surface. An upstanding member in the form of a coated metal knife blade 94 is disposed adjacent the member 86 and extends upwardly toward the undercut surface 92, but stops short thereof at an edge portion 98 to form a slot 96 juxtaposed and opposite the rotary knife 66. The beveled knife edge 68 engages the edge portion 98 of the knife blade 94 for cutting the paper in a shearing action while the paper is pressed against and supported by the knife blade.

Figure 4:
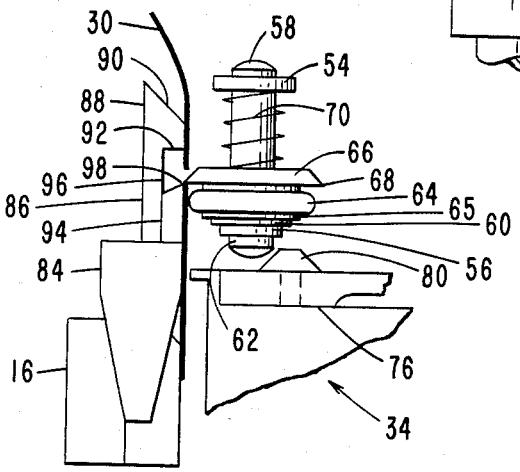
FIG. 4, on the sheet with FIG. 2, is a view similar to a portion of FIG. 3 and showing an operated position of the mechanism.

It should be noted that FIG. 4 illustrates the paper cutting mechanism 34 in an operated position wherein, upon actuation of the solenoid 36 (FIG. 2), the plunger 40 is caused to be moved upwardly in FIG. 2 so as to pivot the bell crank 46 clockwise about pin 48 and move the rotary knife 66 toward the right in the direction of the platen 16. It is seen from FIGS. 3 and 4 that such actuation and movement of the bell crank 46 changes the position of the bell crank stud 58, carrying the rotary knife 66, from atop the cam button 80 (FIG. 3) to a side button position (FIG. 4) wherein the knife edge 68 of the rotary knife 66 engages with and is on the edge 98 of the knife blade 94. It is also noted that when the solenoid 36 is actuated to cut the paper 30 in one or the other direction of travel of the print head, the rotary knife 66 is beyond the edge of the paper and severs the paper as the knife is rotated by reason of the drive roller 64 being against the front surface of the knife blade 94.

Figure 6:
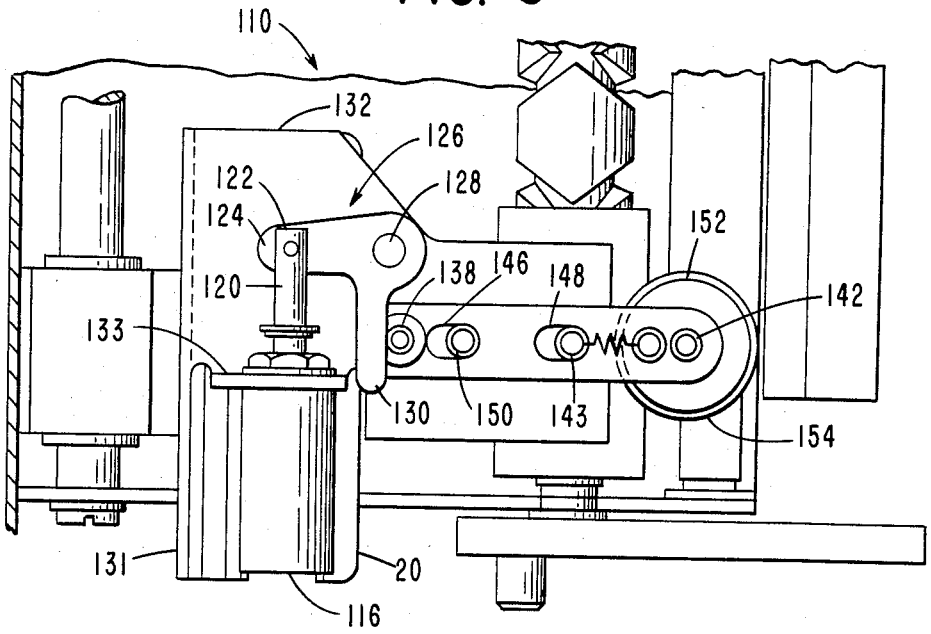
FIG. 6 is a top plan view of the compact rotary knife mechanism in a modified arrangement thereof.
Figure 7:
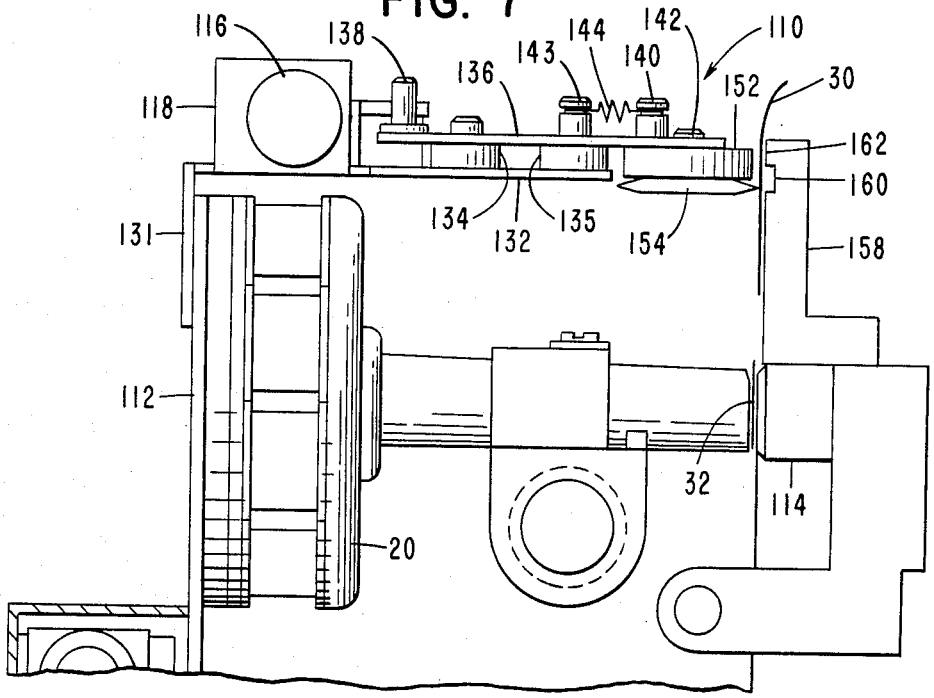
FIG. 7 is a side elevational view of the mechanism shown in FIG. 6.

A modification of the invention is illustrated in FIG. 6 in a top plan view of a paper cutting mechanism 110 which is an arrangement for slicing the paper after printing thereon, and FIG. 7 is a side elevational view of the structure for the slicing concept. The paper cutting mechanism 110 is supported from and carried by the print head carriage 112 (FIG. 7) in the side-to-side direction along the print line. The paper 30 or like record material is unrolled from a roll or spool (not shown) normally positioned in the rear portion of the printer (as described for FIG. 1) and such paper is caused to be transported upwardly past the printing station, and the ribbon 32 is caused to be driven in a generally horizontal direction between the print head 20 and a platen 114, all in the manner as described for the shear concept, but wherein the platen for the slice concept is of different construction and arrangement from the platen assembly shown in FIGS. 1, 2, 3 and 4.

The cutting mechanism 110 includes an electromagnetic solenoid or like device 116 which is placed in a horizontal position and supported in a heat-dissipating cradle 118 (FIG. 7) which is secured to the print head carriage 112. The solenoid 116 has a plunger 120 (FIG. 6) extending to the left thereof and the end 122 of the plunger is pivotally connected to one end 124 of a solenoid drive arm in the form of a bell crank 126 which is pivoted on a pin or stud 128, the bell crank having an arm 130 extending back toward the side of the solenoid 116.

A planar-shaped member or slide bracket 132 is horizontally disposed under the solenoid plunger 120 and the bell crank 126 and extends toward the printing station. The slide bracket 132 includes a downwardly extending portion 131 (FIG. 7) for attaching in suitable manner to the print head carriage 112, and an upwardly extending portion 133 (FIG. 6) for securing the solenoid 116 in the cradle 118. A pair of keeper studs 134 and 135 (FIG. 7) provide spacers for supporting a slide member 136 extending in the direction of the print station. The member 136 includes an upstanding keeper stud 138 engageable by the arm 130 of the bell crank 126. An upstanding portion 143 of stud 135 and a stud 140 are connected by a tension spring 144. The slide member 136 also includes a pair of elongated slots 146 and 148 (FIG. 6), the slot 146 receiving the stud 134 and the slot 148 receiving the portion 143, which portion of stud 135 has one end of the spring 144 connected thereto. The studs 150 and 143 are movable in their respective slots 146 and 148 while the stud 142 is secured to the slide member 136. The stud-and-slot arrangement allows the member 136 to slide a precise distance in the direction toward and away from the print station.

A drive roller 152, which may be made of neoprene or like resilient, frictional surfaced, material, and a rotary knife 154 are journaled on the stud 142 near the end of the slide member 136 and positioned directly above the nose of the print head 20 and adjacent a member above the platen 114.

The platen 114 supports an elongated L-shaped upstanding member or knife anvil 158 (FIG. 7) which includes a slot 160 formed therein juxtaposed and opposite the beveled rotary knife 154. The paper 30 is caused to be taut or stretched across the slot 160 and the knife 154 slices the paper when the solenoid 116 is energized to move the slide member 136 toward the L-shaped member 158 as the paper is pressed and supported thereagainst. The drive roller 152 is in contact with the paper and pressing against the surface portion 162 of member 158 above the slot 160 in frictional manner for rotating the knife 154.

In a typical operation of the paper cutting mechanism 34 for the shear concept or mechanism 110 for the slice concept in a receipt transaction of the printer, a first line is caused to be printed on the receipt paper 30, the paper is moved past the print line in a line feed operation, and the solenoid 36 or 116 is activated for a partial cutting across the paper tape. A line feed operation is then performed, two lines are printed, another line feed of the paper 30 is effected, and the solenoid is activated to cause a full cut of the paper tape to accomplish the receipt function and provide a receipt of the transaction.

It is thus seen that herein shown and described is a rotary knife mechanism for use with a dot matrix printer wherein the mechanism travels with the print head. The knife mechanism is supported and controlled to be operable from a paper non-cutting position to a paper cutting position for a full or partial cut as the print head is moved in transverse direction on the printer. The arrangement enables the accomplishment of the objects and advantages mentioned above, and while a preferred embodiment and a modification have been disclosed herein, other variations may occur to those skilled in the art. It is contemplated that all such variations and modifications not departing from the spirit and scope of the invention hereof are to be construed in accordance with the following claims.

We claim:

1. Mechanism for cutting across a strip of record material being moved along a path in one direction, said mechanism comprising a support member extending transverse to the path of the strip of material, said support member having an edge against which the strip is trained, rotary cutting means, means for carrying the rotary cutting means in transverse direction to the path of the strip of material, cam means on said carrying means and defining an inclined surface and supporting the rotary cutting means in a non-cutting position thereof, and means supported from the carrying means for moving the rotary cutting means from the cam means supported non-cutting position along the inclined surface to a cam means unsupported cutting position wherein the rotary cutting means engages the edge of the support member to cut the strip of material.

2. The mechanism of claim 1 wherein the support member comprises a platen with the strip of record material bearing thereagainst.

3. The mechanism of claim 1 wherein the rotary cutting means comprises a cutting wheel rotatable along the edge of the support member for cutting the strip of record material.

4. The mechanism of claim 1 wherein the cam means comprises a cam button defining symmetrical inclined surfaces and secured to the carrying means for holding the rotary cutting means in the non-cutting position.

5. The mechanism of claim 4 wherein the moving means comprises an electromagnetic member actuated to move the rotary cutting means off the cam button and to place the rotary cutting means in the cutting position.

6. The mechanism of claim 1 including means urging the rotary cutting means into engagement with the cam means in the non-cutting position.

7. The mechanism of claim 1 wherein the cutting mechanism includes resilient drive means engageable with the record material and urged against the support member in the cutting position for causing rotation of the cutting means.

8. The mechanism of claim 1 wherein the rotary cutting means includes a single bevel knife engageable with the edge of the support member for cutting the strip of record material.

9. The mechanism of claim 1 wherein the cutting mechanism includes a bell crank member operable for positioning the rotary cutting means from the non-cutting position to the cutting position.

10. A printer having a print head and a carriage for moving the head along a printing station, record material caused to be moved in a path past the printing station, and record material cutting means comprising a support member extending transverse to the path of the record material and along the printing station, said support member having a surface for bearing the record material, a rotary cutting member, a cutting member carrier connected with the print head carriage for moving therewith, a cam member defining a sloping surface and connected with the cutting member carrier and supporting the rotary cutting member in a non-cutting position thereof, and means supported from the cutting member carrier for moving the rotary cutting member from the cam member supported non-cutting position along the sloping surface to the cutting position wherein the cutting member engages the record material at the surface of the support member for cutting the record material.

11. The printer of claim 10 wherein the support member comprises a platen having an edge portion on the surface thereof for bearing the record material.

12. The printer of claim 10 wherein the rotary cutting member comprises a beveled wheel rotatable along the surface of the support member for cutting the record material.

13. The printer of claim 10 wherein the cam member comprises a conical-shaped member defining symmetrical sloping surfaces and secured to the cutting member carrier for holding the rotary cutting member in the non-cutting position.

14. The printer of claim 13 wherein the moving means comprises a solenoid member actuated to move the rotary cutting member off the conical-shaped member and to place the cutting member in the cutting position.

15. The printer of claim 10 including means urging the rotary cutting member into engagement with the cam member in the non-cutting position.

16. The printer of claim 10 including resilient drive means engageable with the record material and urged against the support member in the cutting position for causing rotation of the cutting member.

17. The printer of claim 12 wherein the support member includes an edge portion and the beveled wheel engages the record material at the edge portion for causing shearing of the record material.

18. The printer of claim 12 wherein the support member includes a slot therealong and the beveled wheel is rotated along the printing station for cutting the record material at the slot.

19. The printer of claim 10 including a bell crank member operable for positioning the rotary cutting member from the non-cutting position to the cutting position.

20. In a dot matrix printer having a print head movable along a print station, the print station including a platen extending across the printer, and a strip of record material caused to be transported in a path past the platen, the improvement comprising means for severing the strip of record material and including a surface portion for bearing the record material, a rotary cutting member, means connected with the print head for carrying the cutting member therewith, a cam member defining an upstanding sloping surface and connected with the carrying means and supporting the rotary cutting member in a non-cutting position, and means for moving the rotary cutting member from the cam member supported non-cutting position along the sloping surface to a cutting position at the surface portion of the platen wherein the cutting member upon rotation thereof cuts the strip of record material along the platen.

21. In the printer of claim 20 wherein the surface portion of the platen includes an edge portion therealong engageable by the rotary cutting member in the cutting position.

22. In the printer of claim 20 wherein the surface portion of the platen defines a slot therein and said rotary cutting member enters the slot for cutting the record material.

23. In the printer of claim 20 including resilient drive means associated with the rotary cutting member and engageable with the record material and urged against the surface portion of the platen for causing rotation of the cutting member in the cutting position.

24. In the printer of claim 21 wherein the cutting member includes a single bevel knife engageable with the edge portion of the platen for cutting the record material.

25. In the printer of claim 22 wherein the rotary cutting member includes a beveled knife rotatable along the print station for cutting the record material at the slot.

26. In the printer of claim 20 wherein the cam member comprises a conical-shaped member having a substantially flat top surface and defining a symmetrical sloping surface and secured to the carrying means for holding the rotary cutting member in the non-cutting position.

27. A cutoff mechanism for cutting a portion of record material from a supply thereof in a printer having a print head carriage and a print head thereon movable in transverse manner along a line of printing, the record material being moved in a path past a printer platen, said cutoff mechanism comprising a support member extending transverse to the path of the record material and including a surface portion for bearing the record material, rotary cutting means, means supported from the print head carriage and carrying the rotary cutting means therewith along the line of printing, the rotary cutting means carrying means comprising a slide bracket and a slide member operable in sliding engagement therewith in a substantially straight path toward and away from the support member, and actuating means supported from the print head carriage for moving the rotary cutting means in slidable manner toward the support member for cutting the record media along the surface portion as the print head is moved across the printer.

28. The cutoff mechanism of claim 27 wherein the support member defines a slot therealong and the rotary cutting means is a beveled wheel rotatable along the slot for cutting the record material.

29. The cutoff mechanism of claim 27 wherein the means carrying the rotary cutting means comprises a bracket having studs therein and a slide member defining elongated holes therein for receiving the studs and permitting sliding movement of the rotary cutting means upon actuation of the actuating means.

30. The cutoff mechanism of claim 27 wherein the actuating means includes a drive arm and the rotary cutting means carrying means comprises a slide member engageable by the drive arm for moving the rotary cutting means toward the support member for cutting the record media.

* * * * *